US006623385B1

(12) United States Patent
Cole et al.

(10) Patent No.: US 6,623,385 B1
(45) Date of Patent: Sep. 23, 2003

(54) ARROWHEAD BUSHING

(75) Inventors: Brian J. Cole, Kendallville, IN (US); Ronald W. Bryie, Kendallville, IN (US)

(73) Assignees: Easy Eye Archery Products, Inc., Allen, MI (US); Rathburn Tool & Manufacturing, Auburn, IN (US)

( * ) Notice: Subject to any disclaimer, the term of this patent is extended or adjusted under 35 U.S.C. 154(b) by 0 days.

(21) Appl. No.: 10/139,884

(22) Filed: May 6, 2002

(51) Int. Cl.[7] ..... F42B 6/04
(52) U.S. Cl. ..... 473/582; 473/578
(58) Field of Search ..... 473/578, 582, 473/583

(56) References Cited

U.S. PATENT DOCUMENTS

| | | | | |
|---|---|---|---|---|
| 3,401,938 | A | | 9/1968 | Bear |
| 3,910,579 | A | | 10/1975 | Sprandel |
| 4,050,696 | A | | 9/1977 | Troncoso, Jr. |
| 4,533,146 | A | | 8/1985 | Schaar |
| 4,558,868 | A | | 12/1985 | Musacchia |
| 4,579,348 | A | | 4/1986 | Jones |
| 4,846,481 | A | * | 7/1989 | Wageman |
| 4,944,520 | A | | 7/1990 | Fingerson et al. |
| 5,067,731 | A | * | 11/1991 | Bickel |
| 5,114,156 | A | | 5/1992 | Saunders |
| 5,145,186 | A | | 9/1992 | Maleski |
| 5,269,534 | A | | 12/1993 | Saunders et al. |
| 5,322,297 | A | | 6/1994 | Smith |
| 5,417,439 | A | * | 5/1995 | Bickel |
| 5,465,979 | A | * | 11/1995 | Buhler |
| 5,494,298 | A | | 2/1996 | Maleski |
| 5,496,042 | A | | 3/1996 | Craft et al. |
| 5,762,574 | A | | 6/1998 | Mashburn |
| 5,921,875 | A | * | 7/1999 | Bickel ..... 473/582 |

* cited by examiner

*Primary Examiner*—John A. Ricci
(74) *Attorney, Agent, or Firm*—Price, Heneveld, Cooper, DeWitt & Litton

(57) ABSTRACT

An arrow that is easily assembled and exhibits improved concentricity between the arrowhead and the arrow shaft includes a hollow arrow shaft, an arrowhead having a tip and a cylindrical shank, and a bushing having a cylindrical section and a tapered section, wherein the cylindrical section of the bushing is received in an end of the hollow arrow shaft and secured to the hollow arrow shaft with an adhesive. The tapered section has a bore in which the shank portion of the arrowhead is received, and the shank portion of the arrowhead is secured within the bore using an adhesive. In accordance with an aspect of the invention, the cylindrical shank portion of the arrowhead has smooth surfaces that engage smooth surfaces of the bore extending through the tapered section of the bushing, whereby the absence of threads and other irregularities on the engaging surfaces between the arrowhead and the bushing improve concentricity among the arrowhead, bushing and arrow shaft.

19 Claims, 1 Drawing Sheet

ARROWHEAD BUSHING

FIELD OF THE INVENTION

This invention pertains generally to arrows used for hunting, target practice, archery competitions and the like, and more particularly to processes and devices for attaching an arrowhead to an arrow shaft.

BACKGROUND OF THE INVENTION

More than a dozen different diameter arrow shafts are currently available to archers. Customarily, various different styles of arrowheads have been made for use with each of a variety of different diameter arrow shafts. As a result, an arrowhead manufacturer that wishes to supply two different styles of arrowheads, (e.g., one broad head and one field tip) for 10 different arrow shaft diameters would need to manufacture 20 different arrowheads. Thus, arrowhead manufacturers typically invest in tooling and equipment for making dozens of different types of arrowheads. Therefore, manufacturers would find it desirable to provide a full range of different types of arrowheads for every available shaft diameter while reducing manufacturing expenses by reducing the amount of tooling and equipment needed to provide a full range of products. In addition, retailers and consumers would benefit if a full range of products could be achieved with fewer components. Accordingly, it would be desirable to provide a means by which an arrowhead can be easily attached to any of a variety of different diameter arrow shafts.

Conventional arrows typically comprise a coupling or insert received in a forward end of an arrow shaft and an arrowhead that is attached to the coupling or insert by way of a threaded connector, whereby the arrowhead is screwed onto the coupling or insert. A disadvantage with this type of arrangement is that unless a level of care beyond that typically exercised in the manufacture of such parts is maintained, slight misalignment of the parts during machining of the threads will result in misalignment of the arrowhead with the arrow shaft. The resulting lack of symmetry, parallelism and concentricity with respect to the longitudinal axis of the arrow will adversely affect the flight of the arrow and reduce accuracy. In addition assembly is difficult and cumbersome due to the threaded connections. Also, care must be taken during assembly to avoid misalignment of the threads and cross threading which would further acerbate problems associated with a lack of symmetry of the arrowhead with respect to the longitudinal axis of the arrow. Accordingly, it would be desirable to provide a means of attaching an arrowhead to an arrow shaft which is easier and ensures excellent symmetry of the arrowhead with respect to the longitudinal axis of the arrow.

A fundamental requirement for optimum arrow performance is that the arrow be properly balanced to attain good arrow flight. An arrow with too little weight at its front will tend to tumble. Arrows must typically have extra weight at the front end to provide guidance for the remainder of the shaft in flight. Various devices and mechanical arrangements have been devised to add and adjust the total weight of an arrow point within a desired overall total weight range. A preferred known means for adjusting the weight and balance of an arrow is a grain rod attachable to the arrow tip. A preferred grain rod is one having a plurality of longitudinally spaced apart circumferential grooves that separate the rod into a plurality of weight segments. The circumferential grooves facilitate separation of one or more of the weight segments from the rod. For example, a known grain rod comprises a plurality of separable weight segments each having a weight of about 10 grains. Thus, if it is desired to reduce the weight of the grain rod by 10 grains, then one of the segments is removed by cutting the grain rod at the circumferential groove between the first weight segment and the second weight segment at one end of the rod. However, it would be desirable to facilitate finer tuning or adjustment of the total weight and balance of the arrow without significantly increasing the number of circumferential grooves on the grain rod.

SUMMARY OF THE INVENTION

The invention provides a means for more quickly and easily attaching an arrowhead to an arrow shaft. The invention also facilitates better symmetry (e.g, concentricity and parallelism) of the arrowhead with the arrow shaft, thereby providing improved flight characteristics and accuracy. The invention also facilitates easy interchangeability of parts, whereby an arrowhead can be used with any of a variety of different arrow shafts having different diameters, or one type of arrowhead may be removed from an arrow shaft and replaced with another type of arrowhead.

In accordance with certain aspects of the invention, an improved grain rod for adjusting the total weight and balance of an arrow is provided. The improved grain rod facilitates finer adjustment of the weight and balance of an arrow without significantly increasing the complexity of the grain rod.

In accordance with one aspect of the invention, there is provided an arrow having a hollow arrow shaft, an arrowhead having a tip portion and a cylindrical shank portion, and a bushing having a cylindrical section and a tapered section. The cylindrical section of the bushing is received in an end of the hollow arrow shaft and secured to the hollow arrow shaft with an adhesive, and the tapered section has a bore in which the shank portion of the arrowhead is received. The shank portion of the arrowhead is secured within the bore with an adhesive.

In accordance with another aspect of the invention there is provided an arrow which includes a hollow arrow shaft having an inner diameter, an arrowhead having a tip portion and a cylindrical shank portion, and a bushing having a cylindrical section and a tapered section. A bore extends through the cylindrical section of the bushing. The bore has an inner diameter at the tapered section of the bushing that is matched to an outer diameter of the cylindrical shank portion of the arrowhead to accommodate receipt of the cylindrical shank portion of the arrowhead into the tapered section of the bushing. The cylindrical section of the bushing has an outer diameter matched to the inner diameter of the hollow arrow shaft to accommodate receipt of the cylindrical section of the bushing into an end of the arrow shaft. The cylindrical shank portion of the arrowhead has smooth surfaces that engage smooth surfaces of the bore extending through the tapered section of the bushing, whereby the absence of threads and other irregularities on the engaging surfaces between the arrowhead and the bushing improve concentricity among the arrowhead, bushing and arrow shaft.

In accordance with another aspect of the invention, there is provided a device for adjusting the weight and balance of an arrow. The device includes a rod having a plurality of longitudinally spaced apart circumferential grooves that define separable weight segments between the circumferential grooves. The rod includes at least one weight segment having a weight that is substantially different from the weight of another weight segment.

These and other features, advantages and objects of the present invention will be further understood and appreciated by those skilled in the art by reference to the following specification, claims and appended drawings.

DETAILED DESCRIPTION OF PREFERRED EMBODIMENTS

Figure 1:
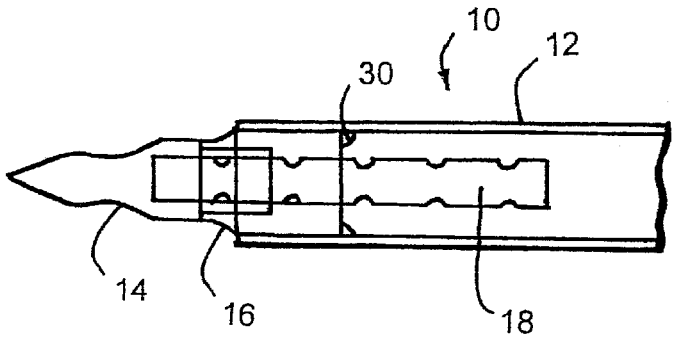
FIG. 1 is a fragmented longitudinally cross section of an arrow in accordance with this invention.

In FIG. 1 there is shown an arrow assembly in accordance with the invention. The arrow can include a hollow arrow shaft 12, an arrowhead 14, and a bushing 16. Arrow 10 may also include a grain rod 18 for adjusting the weight and balance of the arrow.

Figure 2:
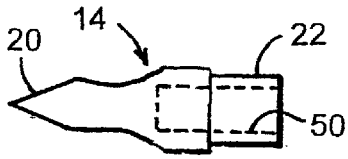
FIG. 2 is a side view of an arrowhead used in the arrow shown in FIG. 1.

FIG. 2 shows arrowhead 14 separate from the arrow assembly. Arrowhead 14 includes a tip portion 20 and a cylindrical shank portion 22. Although illustrated arrowhead 14 is a field tip typically used for practice on targets, and therefore does not include blades or barbs, the concepts of the invention may be utilized with other types of arrowheads, including broad heads and other arrowheads having blades and/or barbs.

Figure 3:
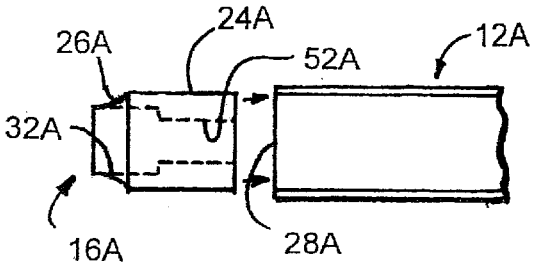
FIG. 3 is a side view of a bushing shown in FIG. 1 adjacent a fragmented view of an arrow shaft into which the bushing is inserted.

FIG. 3 shows a bushing 16A having a cylindrical section 24A and a tapered section 26A. Cylindrical section 24A of busing 16A has an outer diameter matched to the inner diameter of hollow arrow shaft 12A, whereby cylindrical section 24A of bushing 16A can be received in an end 28A of hollow arrow shaft 12A. The outer diameter of cylindrical section 24A of bushing 16A is about equal to, or preferably slightly smaller than, the inner diameter of arrow shaft 12A. The cylindrical section 24A may be retained in end 28A of arrow shaft 12A by frictional engagement of the outer walls of cylindrical portion 24A with the interior walls of hollow arrow shaft 12A, and bushing 16A is preferably firmly secured in the end of arrow shaft 12A with an adhesive residing in an annular space between the outer walls of cylindrical section 24A of bushing 16A and the interior walls of hollow arrow shaft 12A. An adhesive may be applied to the exterior wall surfaces of cylindrical section 24A of bushing 16A and/or to interior wall surfaces of arrow shaft 12A proximate to end 28A of arrow shaft 12A prior to inserting the cylindrical section 24A of bushing 16A into arrow shaft 12A. Any excess adhesive may accumulate to form a ring 30 as shown in FIG. 1.

Any of a variety of commercially available adhesive compositions may be employed for securing bushing 16 in shaft 12. However, thermoplastic adhesives which can be melted by application of heat to facilitate decoupling of the arrowhead from the bushing and/or decoupling of the bushing from the arrow shaft are preferred to facilitate replacement of the arrowhead 14 with a different arrowhead or to mount arrowhead 14 on a different arrow shaft. Particularly preferred are liquid thermoplastic adhesives comprising a thermoplastic adhesive material dissolved in a volatile solvent. These liquid thermoplastic adhesives can be easily applied as a liquid to surfaces that are to be bonded together, harden quickly, and can be subsequently melted to allow the surfaces to be debonded or decoupled. Examples of suitable liquid thermoplastic adhesives include acrylic, polyester, polyamide and vinyl based thermoplastic adhesives.

Bushing 16A includes a bore 32A that extends through the tapered section 26A of the bushing. Bore 32A has an inner diameter that is matched to the outer diameter of the cylindrical shank portion 22 of arrowhead 14 to accommodate receipt of the cylindrical shank portion 22 of arrowhead 14 into tapered section 26A of bushing 16A. The outer diameter of shank portion 22 of arrowhead 20 is about equal to or slightly smaller than the inner diameter of bore 32A whereby the outer surfaces of cylindrical shank portion 22 may frictionally engage the inner surfaces of bore 32A to retain arrowhead 14 in bushing 16A. Preferably, arrowhead 14 is secured to bushing 16A with an adhesive disposed in any annular space between the outer surfaces of cylindrical shank portion 22 of arrowhead 14 and the inner surfaces of bore 32A of bushing 16A. Any of a variety of commercially available adhesives may be employed for securing arrowhead 14 to bushing 16A. However, in order to allow decoupling of arrowhead 14 from bushing 16A, it is preferred to use thermoplastic adhesives, and in particular, liquid thermoplastic adhesives that can be applied to the surfaces which are to be joined together, and which quickly harden, and which can be melted upon application of heat to facilitate separation of arrowhead 14 from bushing 16A.

Figure 4:
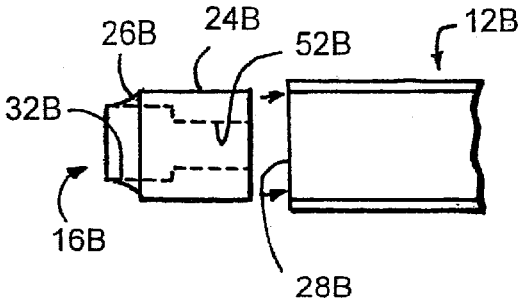
FIG. 4 is a side view of a bushing similar to that shown in FIG. 3 but having a larger diameter and shown adjacent a fragmented view of a larger diameter arrow shaft.

In FIG. 4, there is shown a busing 16B having a cylindrical section 24B and a tapered section 26B. Bushing 16B is generally similar to bushing 16A shown in FIG. 3, except that the diameter of cylindrical section 24B is larger than the diameter of cylindrical section 24A of bushing 16A, whereby bushing 16B may be inserted into end 28B of arrow shaft 12B, which has both inner and outer diameters that are larger than those of arrow shaft 12A. However, bore 32B of bushing 16B has dimensions identical with those of bore 32A of bushing 16A. This allows arrowhead 14 to be coupled to smaller diameter arrow shaft 12A using bushing 16A, or to larger diameter arrow shaft 12B using bushing 16B.

As shown in FIGS. 2–4, the engaging surfaces between shank 22 of arrowhead 14 and bore 32A or 32B of bushing 16A or 16B are smooth, i.e., free of threads and other irregularities. This allows arrowhead 14 to slide directly into bushing 16A or 16B. This facilitates easier mounting of arrowhead 14 onto bushing 16A or 16B than would be possible with a threaded connection, and facilitates improved concentricity between arrowhead 14 and bushing 16A or 16B, which in turn facilitates improved concentricity between arrowhead 14 and arrow shaft 12A or 12B. Similarly, the engaging surfaces between the cylindrical section 24A or 24B of bushing 16A or 16B and the interior of arrow shaft 12A or 12B are smooth, i.e., free of threads or other irregularities, thereby facilitating easy connection of bushing 16A or 16B arrow shaft 12A or 12B, and facilitating improved concentricity among arrowhead 14, bushing 16A or 16B, and arrow shaft 12A or 12B. The resulting improved concentricity and symmetry with respect to the longitudinal axis of the arrow shaft provides improved aerodynamics, a truer flight, and improved accuracy. In addition, improved concentricity also reduces damage to targets when a field tip (e.g., arrowhead 14) is used.

The three primary types of bows which are in use include recurve bows, compound bows, and long bows. Each of these bows requires arrows of different weights to achieve optimum performance at a given peak draw weight. Typically, long bow arrows require a weight of from about 6.5 to about 7.5 grains per pound of force at the peak draw of the bow. Recurve bows require arrows having a weight of from about 7 to about 8 grains per pound of force at the peak draw of the bow. Compound bows require arrows having a weigh of from about 8 to about 9 grains per pound of force at the peak draw of the bow. For example, a 60 pound bow may require an arrow weight of 420 grains for a long bow, about 480 grains for a recurve bow, and about 540 grains for a compound bow. At these weights, the arrows will provide optimum limb loading and velocity (assuming the use of bows of equal efficiency).

Also, in order to achieve optimum flight, it is necessary to balance the arrow so that approximately 60% of the total arrow weight is at the front half of the arrow. Accordingly, there is a recognized need for providing a means for adjusting both the total weight and balance of an arrow. A recognized technique for adjusting the weight and balance of an arrow involves use of a grain rod having a plurality of weight segments of equal weight separated from each other by circumferential grooves that are longitudinally spaced apart form each other along the length of the grain rod. The longitudinal grooves demarcate the weight segments and provide a small cross section that can be easily cut remove one or more weight segments. A conventional grain rod of this type typically has 10 grain weight segments. Accordingly, the weight of the grain rod is intended to be adjusted in 10 grain increments.

Figure 5:
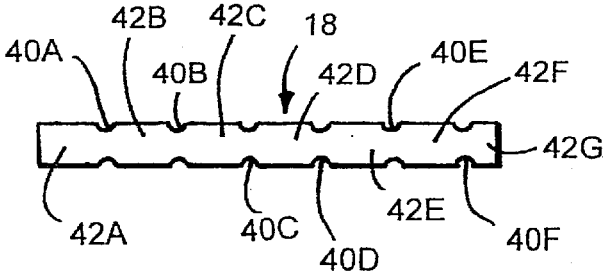
FIG. 5 is a side view of a grain rod used in the arrow assembly shown in FIG. 1.

Grain rod 18 (FIGS. 1 and 5) represents an improvement over conventional grain rods having longitudinally spaced apart circumferential grooves that define separable weight segments. In particular, grain rod 18 includes, at one end thereof, a separable weight segment that is substantially different form the weight of another weight segment. For example, FIG. 5 shows grain rod 18 having a plurality of longitudinally spaced apart circumferential grooves 40 that define separable weight segments 42A, 42B, 42C, 42D, 42E, 42F and 42G. Weight segments 42A through 42F are all about the same weight (e.g., 10 grains), whereas the weight of weight segment 42G is substantially different from the weight of segment 42A through 42E. For example, to allow a 5 grain incremental adjustment without significantly increasing the number of segments required, segments 42A through 42F may each weight 10 grains, whereas segment 42G weighs 5 grains. For example, grain rod 18 shown in FIG. 5 may be used without modification to add 65 grains of weight to the front half of an arrow, severed at circumferential groove 40A to provide a rod having a weight of 55 grains, severed at circumferential groove 40F to provide a 60 grain rod, severed at circumferential groove 40B to provide a 45 grain rod, severed at circumferential groove 40E to provide a 50 grain rod, etc. The overall effect is that finer tuning of the weight and/or balance of the arrow can be achieved without significantly increasing the complexity and manufacturing cost of the grain rod. More specifically, by adding a single weight segment 42G that is about half the weight of the remaining segments 40A through 40F, the precision of the weight adjustment is doubled (e.g., from within 5 grains of the desired weight to within 2.5 grains of the desired weight).

As shown in FIG. 24, arrowhead 14 is provided with a bore 50 having an inner diameter matched to the outer diameter of the weight segments of grain rod 18, and bushings 16A and 16B are provided with bores 52A and 52B which also have a diameter matched to the diameter of weight segments 42A–42G of grain rod 18. As shown in FIGS. 3 and 4, bores 32A and 52A (and 32B and 52B) are joined to provide a dual diameter bore extending through bushing 16A (and 16B). Grain rod 18 may be inserted through bore 52A (or 52B) and into bore 50 of arrowhead 20. Preferably the dimensions of grain rod 18, bore 50 and bore 52A (or 52B) are selected to allow grain rod 18 to be easily inserted through bore 52A (or 52B) and into bore 50, and be retained by frictional engagement between the surfaced of grain rod 18 and the surfaces of bores 50 and 52A (or 52B). If desired, grain rod 18 may be more firmly secured to arrowhead 14 and/or bushing 16A (or 16B) with an adhesive with thermoplastic adhesives that facilitate separation of grain rod 18 from arrowhead 14 and bushing 16A (or 16B) being preferred.

An arrow in accordance with-this invention may be assembled by optionally applying an adhesive to cylindrical shank portion 22 and/or bore 32A (or 32B) and inserting the shank portion 22 into bore 32A (or 32A). Thereafter grain rod 18 may be appropriately trimmed to achieve the desired weight and attached (with or without adhesive) to bushing 16A (or 16B) and, arrowhead 14 by insertion through bore 52A (or 52B) and into bore 50. Thereafter, the resulting assembly comprising arrowhead 14, bushing 16A (or 16B) and optionally grain rod 18, is inserted into the front end of arrow shaft 12 as shown in FIG. 1, either with or without and adhesive applied to the engaging surfaces of arrow shaft 12 and cylindrical section 24A (or 24B) of bushing 16 (or 16B).

The expression "substantially different" and variations thereof used to describe differences in the weight of the segments of a grain rod having a plurality of segments refers to a difference that exceeds normal variations that occur during the manufacture of a grain rod intended to have a plurality of weight segments of identical weight. Preferably, one of the weight segments has a weight that is about half of the weight of another weight segment.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. An arrow comprising:

a hollow arrow shaft having an inner diameter;

an arrowhead having a tip portion and a cylindrical shank portion, the cylindrical shank potion having an outer diameter; and a bushing having a cylindrical section and a taper section, a bore extending through the tapered section of the bushing, the bore having an inner diameter at the tapered section of the bushing that is matched to the outer diameter of the cylindrical shank portion of the arrowhead to accommodate receipt of the cylindrical shank portion of the arrowhead into the tapered section of the bushing, the cylindrical section of the bushing having an outer diameter matched to the inner diameter of the hollow arrow shaft to accommodate receipt of the cylindrical section of the bushing into an end of the arrow shaft, the cylindrical shank portion of the arrowhead having smooth surfaces that engage smooth surfaces of the bore extending through the tapered section of the bushing, whereby the absence of threads and other irregularities on the engaging surfaces between the arrowhead and the bushing improve concentricity among the arrowhead, bushing and arrow shaft.

2. The arrow of claim 1, wherein the cylindrical section of the bushing has smooth outer surfaces that engage smooth inner surfaces of the hollow arrow shaft, whereby the absence of threads and other irregularities on the engaging surfaces between the bushing and the arrow shaft improve concentricity among the arrowhead, bushing and arrow shaft.

3. The arrow of claim 2, wherein an adhesive is utilized to secure the bushing to the arrow shaft and to secure the arrowhead to the bushing.

4. The arrow of claim 3, wherein the adhesive is a thermoplastic adhesive, whereby the adhesive can be melted to facilitate separation of the arrowhead from the bushing and/or separation of the bushing from the arrow shaft.

5. The arrow of claim 1, further comprising a grain rod for adjusting the weight and balance of the arrow, the grain rod having longitudinally spaced apart circumferential grooves that define separable weigh segments between the circumferential grooves, the grain rod being fixed to the bushing and/or the arrowhead.

6. The arrow of claim 5, wherein the grain rod includes a plurality of weight segments, at least one of the weight segments having a weight that is substantially different from the weight of another weight segment.

7. The arrow of claim 5, wherein one of the weight segments of the grain rod has a weight that is about half of the weight of another weight segment.

8. An arrow comprising:

a hollow arrow shaft;

an arrowhead having a tip portion and a cylindrical shank portion; and a bushing having a cylindrical section and a tapered section wherein the cylindrical section of the bushing is received in an end of the hollow arrow shaft and secured to the hollow arrow shaft with an adhesive, and the tapered section has a bore in which the shank portion of the arrowhead is received, the shank portion of the arrowhead being secured within the bore with an adhesive.

9. The arrow of claim 8, wherein the cylindrical shank portion of the arrowhead has smooth surfaces that engage smoother surfaces of the bore extending through the tapered section of the bushing, whereby the absence of threads and other irregularities on the engaging surfaces between the arrowhead and the bushing improve concentricity among the arrowhead, bushing and arrow shaft.

10. The arrow of claim 8, wherein the cylindrical section of the bushing has smooth outer surfaces that engage smooth inner surfaces of the hollow arrow shafts, whereby the absences of threads and other irregularities on the engaging surfaces between the bushing and the arrow shaft improve concentricity among the arrowhead, bushing, and arrow shaft.

11. The arrow of claim 8, wherein the adhesives used to secure the bushing to the arrow shaft and to secure to the arrowhead to the bushing are thermoplastic adhesives, whereby the adhesives can be melted to facilitate separation of the arrowhead from the bushing and/or separation of the bushing from the arrow shaft.

12. The arrow of claim 8, further comprising a grain rod for adjusting the weight and balance of the arrow, the grain rod having longitudinally spaced apart circumferential grooves that define separable weight segments between the circumferential grooves, the grain rod being fixed to the bushing and/or the arrowhead.

13. The arrow of claim 12, wherein the grain rod include a plurality of weight segment, at least one of the weight segments having a weight that is substantially different from the weight of another weight segment.

14. The arrow of claim 12, wherein one of the weight segments of the grain rod has a weight that is about half of the weight of another weight segment.

15. A device for adjusting the weight and balance of an arrow, comprising:

a rod having a plurality of longitudinally spaced apart circumferential grooves that define separable weight segments, the rod including at least one weight segment having a weight that is substantially different from the weight of another weight segment.

16. The device of claim 15, wherein one of the weight segments has a weight that is about half of the weight of another weight segment.

17. An arrow kit with interchangeable parts, comprising:

a first arrow shaft having an inner diameter;

a second arrow shaft having an inner diameter that is different from the inner diameter of the first arrow shaft;

an arrowhead having a tip portion and a cylindrical shank portion, the cylindrical shank portion having an outer diameter;

a first bushing having a cylindrical section and a tapered section, a bore extending through the tapered section of the bushing, the bore having an inner diameter at the tapered section of the bushing that is matched to the outer diameter of the cylindrical shank portion of the arrowhead to accommodate receipt of the cylindrical shank portion of the arrowhead into the tapered section of the bushing, the cylindrical section of the bushing having an outer diameter matched to the inner diameter of the first arrow shaft to accommodate receipt of the cylindrical section of the first bushing into an end of the first arrow shaft;

and a second bushing having a cylindrical section and a tapered section, a bore extending through the tapered section of the second bushing, the bore having an inner diameter at the tapered section of the second bushing that is matched to the outer diameter of the cylindrical shank portion of the arrowhead to accommodate receipt of the cylindrical shank portion of the arrowhead into the tapered section of the second bushing, the cylindrical section of the second bushing having an outer diameter matched to the inner diameter of the second hollow arrow shaft to accommodate receipt of the cylindrical section of the second bushing into an end of the second arrow shaft;

whereby the arrowhead may be secured to either the first arrow shaft using the first bushing or to the second arrow shaft using the second bushing.

18. The arrow kit of claim 17, wherein the cylindrical shank portion of the arrowhead has smooth surfaces that are engagable with smooth surfaces of the bore extending through the tapered section of either the first bushing or the second bushing, whereby the absence of threads or other irregularities on the engaging surfaces between the arrowhead and either the first bushing or the second bushing improve concentricity between the arrowhead and the first bushing or second bushing when the arrowhead is inserted into the-first bushing or second bushing.

19. The arrow of claim 17, wherein the cylindrical section of the first bushing has smooth outer surfaces that are engagable with smooth inner surfaces of the first arrow shaft, whereby the absence of threads and other irregularities on the engaging surfaces between the first bushing and the first arrow shaft improve concentricity between the first bushing and the first arrow shaft when the first bushing is inserted into the first arrow shaft.

* * * * *

UNITED STATES PATENT AND TRADEMARK OFFICE

CERTIFICATE OF CORRECTION

PATENT NO. : 6,623,385 B1
DATED : September 23, 2003
INVENTOR(S) : Brian J. Cole et al.

It is certified that error appears in the above-identified patent and that said Letters Patent is hereby corrected as shown below:

Column 3,
Line 10, “longitudinally” should be -- longitudinal --.
Line 41, “busing” should be -- bushing --.

Column 4,
Line 33, “busing” should be -- bushing --.

Column 5,
Line 10, “weigh” should be -- weight --.
Lines 26 and 38, “form” should be -- from --.
Line 28, before “remove” insert -- to --.
Line 48, “weight” should be -- weigh --.
Line 65, “Fig. 24” should be -- Figs. 2-4 --.

Column 6,
Line 11, “surfaced” should be -- surface --.
Line 22, “(or 32A)” should be -- (or 32B) --.
Line 28, “and” should be -- an --.
Line 31, “bushing 16” should be -- bushing 16A --.
Line 53, “potion” should be -- portion --.
Line 55, “taper” should be -- tapered --.

Column 7,
Line 23, “weigh” should be -- weight --.
Line 60, after “secure” delete “to”.

UNITED STATES PATENT AND TRADEMARK OFFICE

CERTIFICATE OF CORRECTION

PATENT NO. : 6,623,385 B1
DATED : September 23, 2003
INVENTOR(S) : Brian J. Cole et al.

It is certified that error appears in the above-identified patent and that said Letters Patent is hereby corrected as shown below:

Column 8,
Line 4, “include” should be -- includes --.
Line 5, “segment” should be -- segments --.

Signed and Sealed this

Third Day of February, 2004

JON W. DUDAS
*Acting Director of the United States Patent and Trademark Office*